US008127682B1

(12) United States Patent
Sonday et al.

(10) Patent No.: US 8,127,682 B1
(45) Date of Patent: Mar. 6, 2012

(54) CAST BOOSTER USING NOVEL EXPLOSIVE CORE

(76) Inventors: John Sonday, McEwen, TN (US); Rick Spriggle, Clarksville, TN (US); Dan Wasson, Dickson, TN (US)

( * ) Notice: Subject to any disclaimer, the term of this patent is extended or adjusted under 35 U.S.C. 154(b) by 66 days.

(21) Appl. No.: 11/344,662

(22) Filed: Feb. 1, 2006

(51) Int. Cl.
*F42B 3/00* (2006.01)
*C06C 5/04* (2006.01)

(52) U.S. Cl. ..... 102/275.4; 102/332

(58) Field of Classification Search ..... 102/301, 102/304, 318, 331, 332, 275.1, 275.2, 275.4, 102/275.8, 275.12, 333
See application file for complete search history.

(56) References Cited

U.S. PATENT DOCUMENTS 231,348 A * 8/1880 Nobel ..... 102/332
(Continued)

*Primary Examiner* — Bret Hayes
(74) *Attorney, Agent, or Firm* — Waddey & Patterson, P.C.; Ryan D. Levy

(57) ABSTRACT

An improved cast booster design and method of assembly is provided for the detonation of blasting agents. The booster design utilizes a pre-formed core that simplifies assembly of the booster and increases the reliability of detonation transfer from a blasting cap. The pre-formed core has a cup shaped aperture provides improved coupling with the initiation source. The pre-formed core is made using a relatively insensitive explosive composition that can be manufactured using high speed pressing methods. The explosive composition allows for the attainment of a well defined shape with a predictable density. The pre-formed core shape mates with the casting mold in a way that ensures the location of the core within the booster thereby improving reliability and reducing labor associated with the booster manufacturing operation.

20 Claims, 14 Drawing Sheets

U.S. PATENT DOCUMENTS

| | | | | | |
|---|---|---|---|---|---|
| 3,037,452 | A | * | 6/1962 | Cook et al. | 102/332 |
| 3,155,552 | A | * | 11/1964 | Vriesen | 149/19.5 |
| 3,183,836 | A | * | 5/1965 | Griffith | 102/331 |
| 3,604,353 | A | * | 9/1971 | Newman | 102/332 |
| 3,777,662 | A | * | 12/1973 | Lingens et al. | 102/332 |
| 3,831,522 | A | * | 8/1974 | Romney | 102/318 |
| 3,851,586 | A | * | 12/1974 | Eller et al. | 102/276 |
| 3,991,679 | A | * | 11/1976 | Savitt et al. | 102/275.4 |
| 4,270,455 | A | | 6/1981 | Janoski | 102/318 |
| 4,331,081 | A | | 5/1982 | Cloutier et al. | 102/318 |
| 4,334,476 | A | * | 6/1982 | Day et al. | 102/275.7 |
| 4,383,484 | A | * | 5/1983 | Morrey | 102/275.3 |
| 4,481,884 | A | | 11/1984 | Yunan | 102/313 |
| 4,495,867 | A | | 1/1985 | Mitchell, Jr. et al. | 102/275.4 |
| 4,616,566 | A | | 10/1986 | Yates, Jr. | 102/275.4 |
| 4,637,312 | A | * | 1/1987 | Adams et al. | 102/275.12 |
| 4,689,096 | A | | 8/1987 | Villamagna et al. | 149/2 |
| 4,711,177 | A | | 12/1987 | Foster, Jr. et al. | 102/204 |
| 4,938,143 | A | * | 7/1990 | Thomas et al. | 102/318 |
| 5,123,356 | A | * | 6/1992 | Brooks et al. | 102/275.12 |
| 5,221,810 | A | | 6/1993 | Spahn | 102/475 |
| 5,233,929 | A | | 8/1993 | Spahn | 102/475 |
| 5,392,713 | A | * | 2/1995 | Brown et al. | 102/322 |
| 5,614,693 | A | | 3/1997 | Welch | 102/318 |
| 5,780,764 | A | | 7/1998 | Welch et al. | 102/318 |
| 6,186,069 | B1 | | 2/2001 | Dippenaar | 102/318 |
| 6,578,490 | B1 | * | 6/2003 | Francisco | 102/275.11 |
| 7,015,334 | B2 | | 3/2006 | Quinlin et al. | 548/421 |

* cited by examiner

SECTION I-I

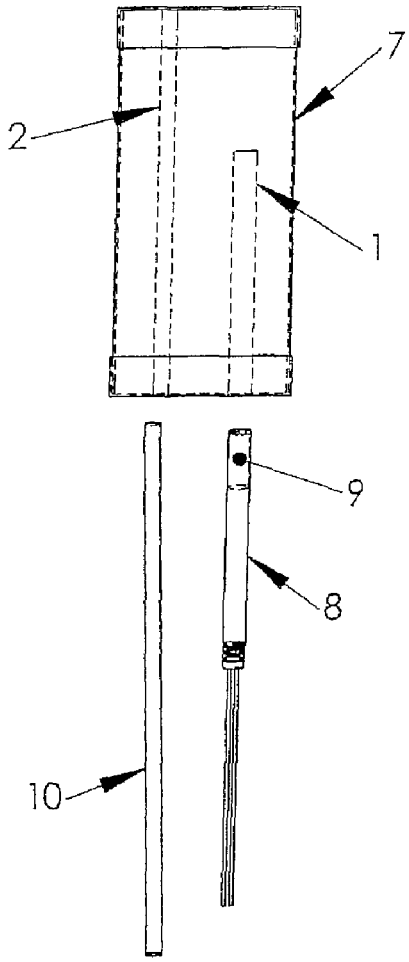
FIG. 2A
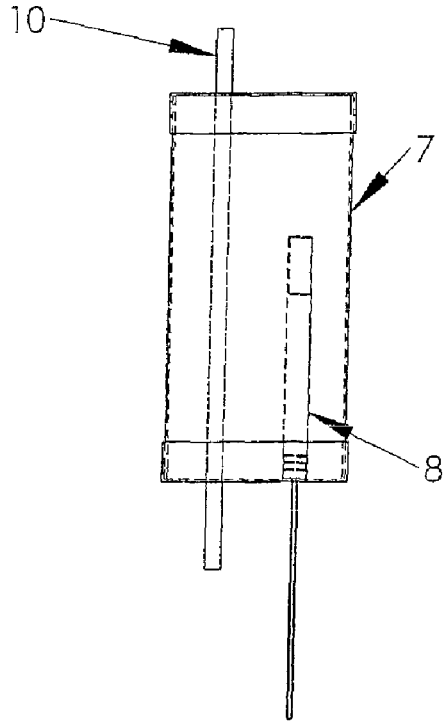
FIG. 2B
FIGURE 2
(PRIOR ART)

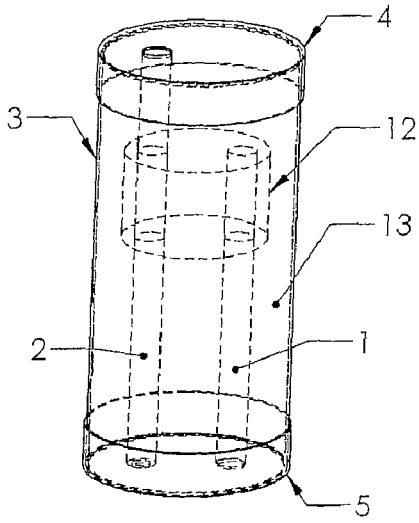
FIG. 4A
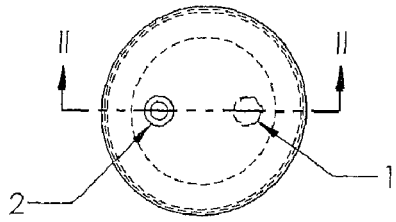
FIG. 4B
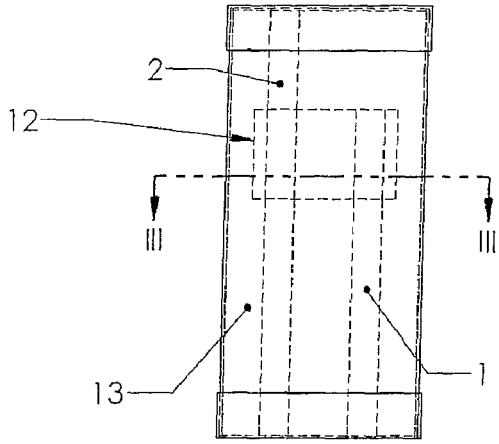
FIG. 4C
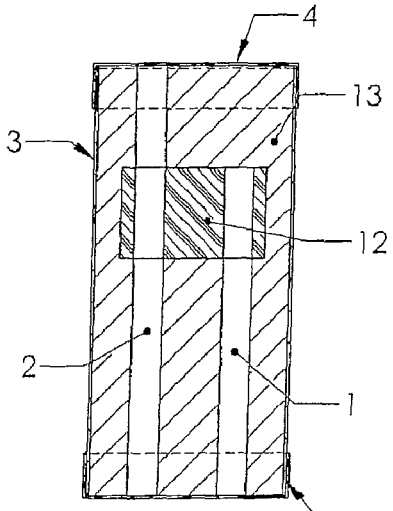
SECTION II-II
FIG. 4E
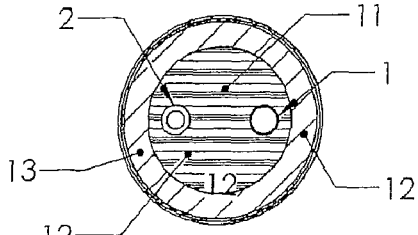
SECTION III-III
FIG. 4D
Figure 4

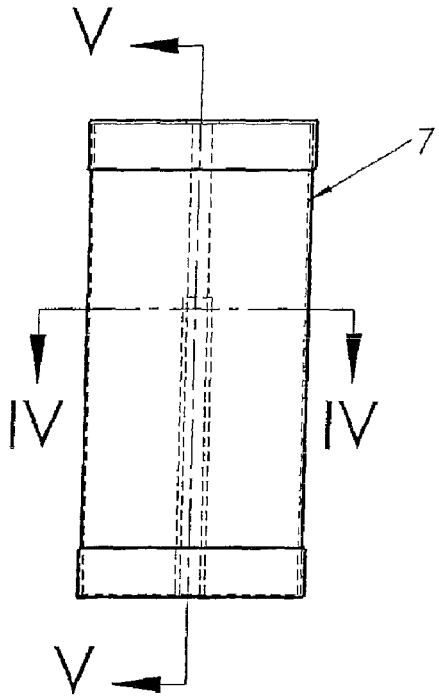
FIG. 5A
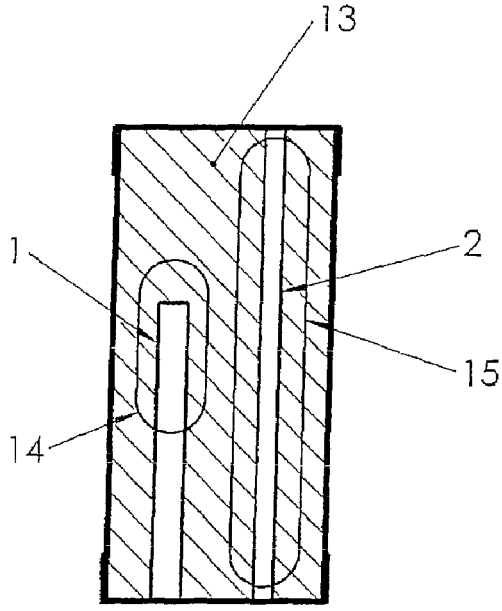
SECTION V-V
FIG. 5B
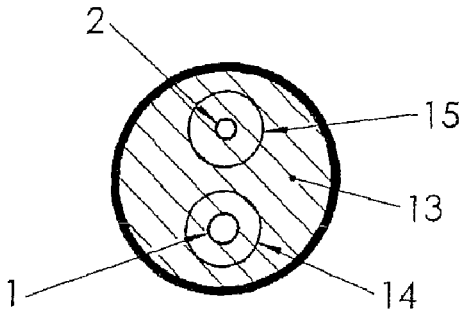
SECTION IV-IV
FIG. 5C
FIGURE 5

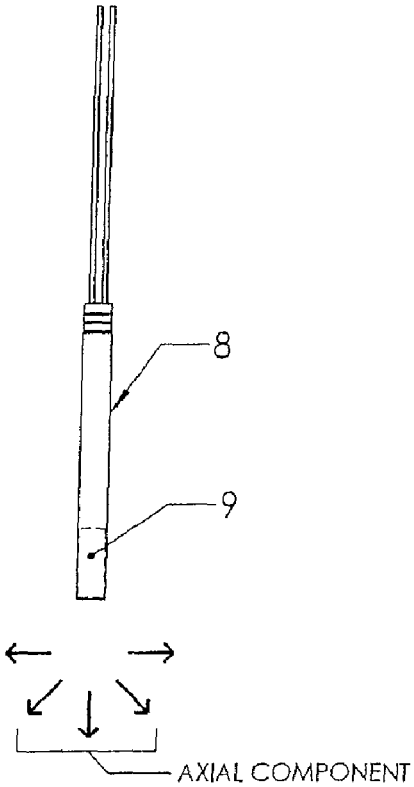
FIG. 6A
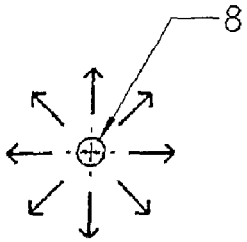
FIG. 6B
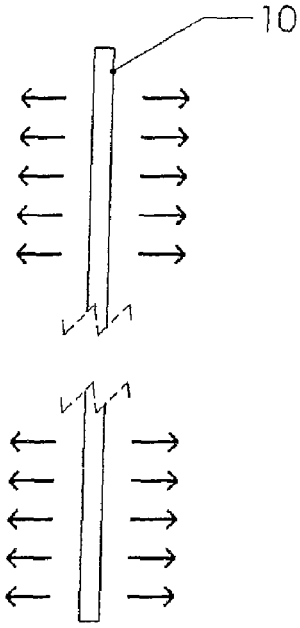
FIG. 6C
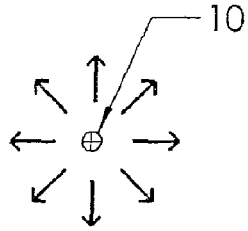
FIG. 6D
FIGURE 6
(PRIOR ART)

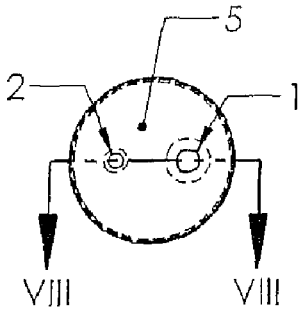
FIG. 9A
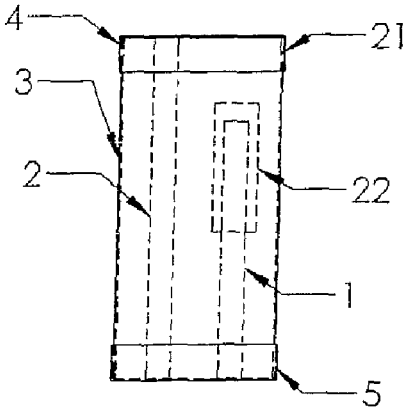
FIG. 9B
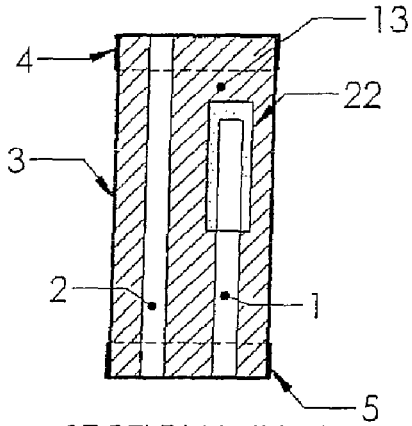
SECTION VIII-VIII
FIG. 9C
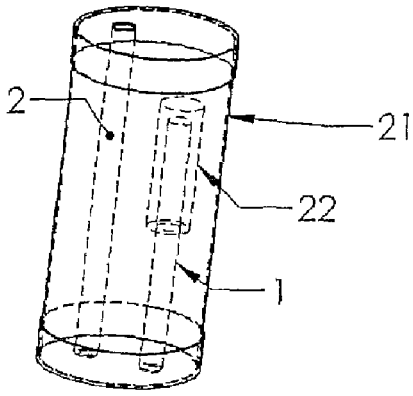
FIG. 9D
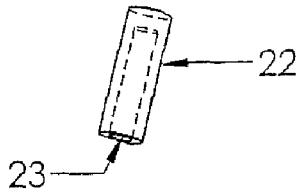
FIG. 9E
FIGURE 9

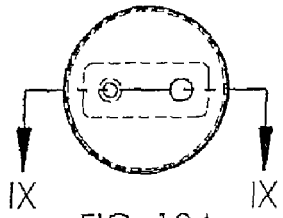
FIG. 10A
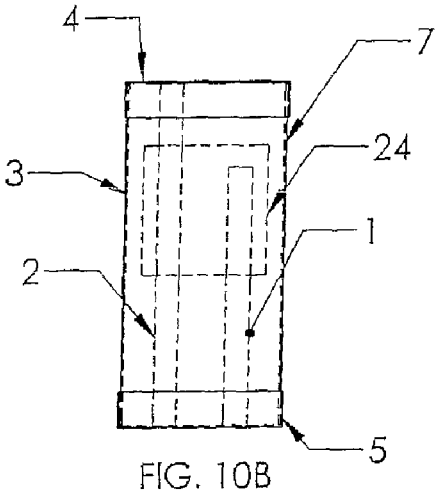
FIG. 10B
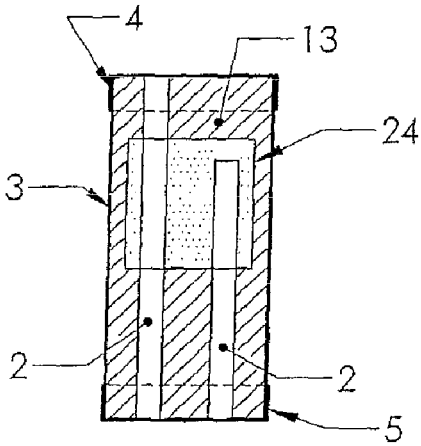
SECTION IX-IX
FIG. 10C
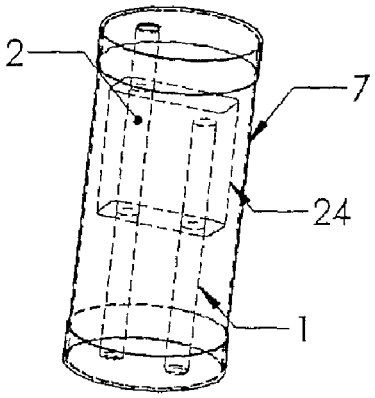
FIG. 10D
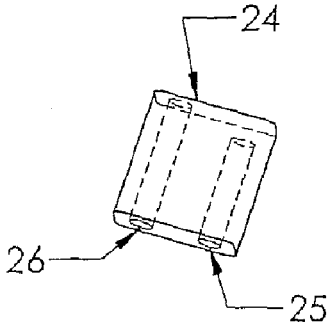
FIG. 10E
FIGURE 10

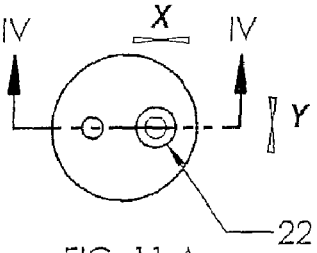
FIG. 11 A
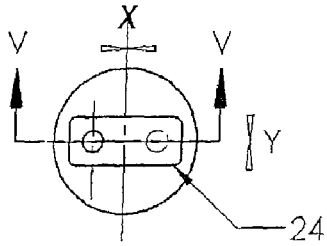
FIG. 12A
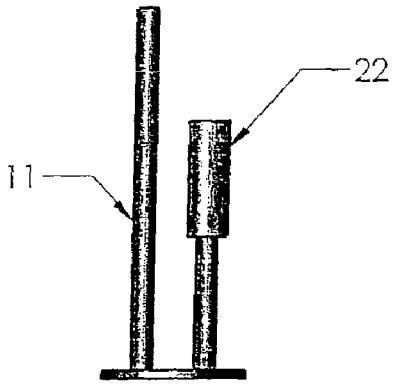
FIG. 11B
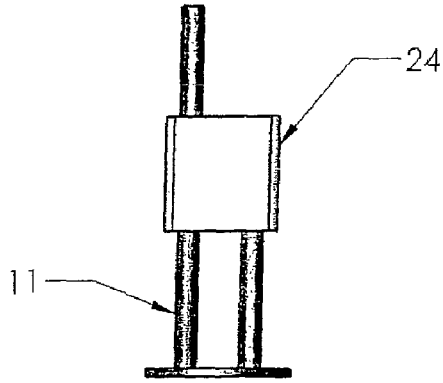
FIG. 12 B
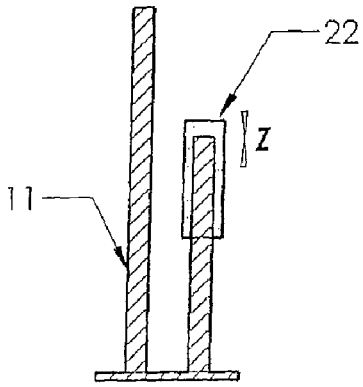
SECTION IV-IV
FIG. 11C
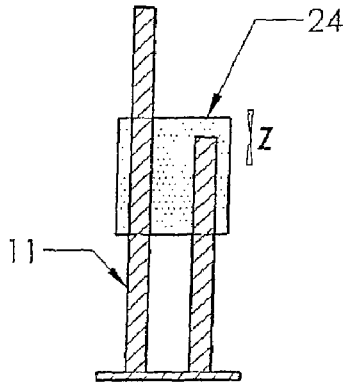
SECTION V-V
FIG. 12 C
FIGURE 11
FIGURE 12

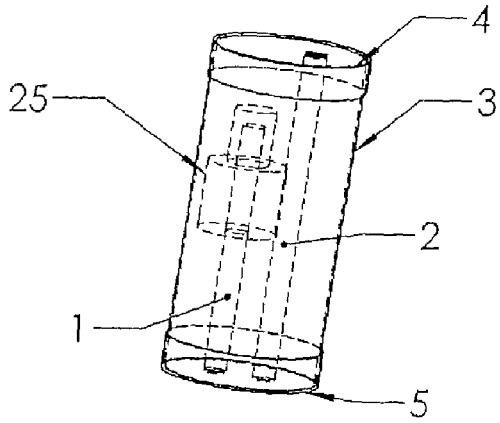
FIG. 13 A
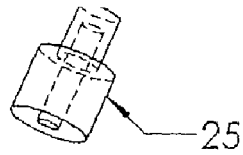
FIG. 13 B
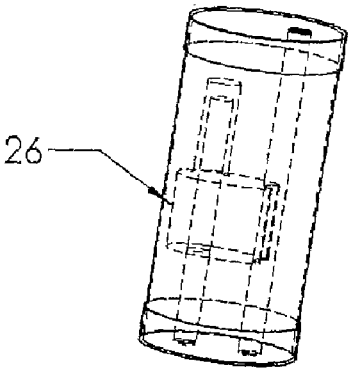
FIG. 13 C
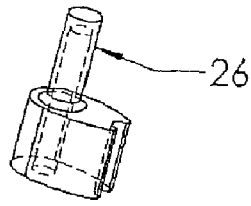
FIG. 13 D
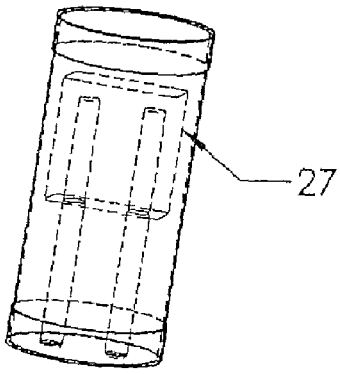
FIG. 13 E
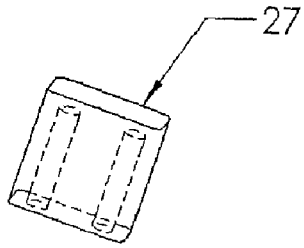
FIG. 13 F
FIGURE 13

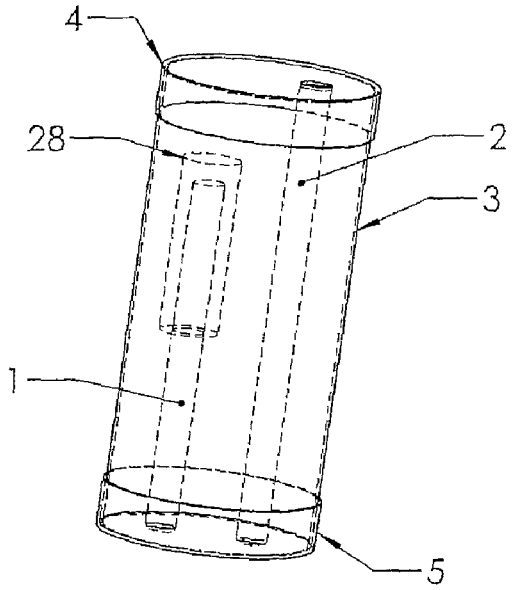
FIG. 14A
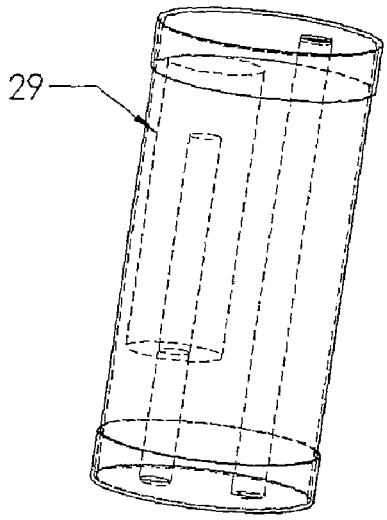
FIG. 14B
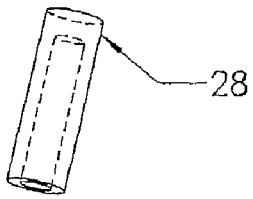
FIG. 14C
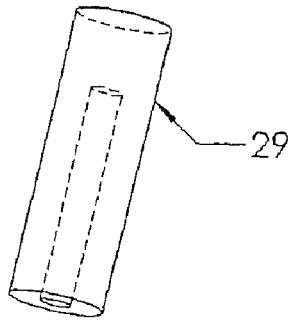
FIG. 14D
FIGURE 14

CAST BOOSTER USING NOVEL EXPLOSIVE CORE

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

FIELD OF THE INVENTION

This invention relates to devices commonly referred to in the explosives and mining industry as boosters, cast boosters or primers as well as explosives in general of small diameter.

BACKGROUND OF THE INVENTION

The blasting industry is involved in numerous activities such as mining, road construction, demolition and seismic exploration. The blasting industry provides the explosive materials and the skills required to perform work in these areas. The combustion, i.e. detonation, of the explosives results in the generation of high quantities of energy in a very short period of time. This energy is used to perform work such as earth excavation and rock fracturing. The proper utilization of explosives in these applications involves numerous methods and techniques. For example, a typical mining application requires a large amount of energy to break rock and move it into a recoverable location. In order to accomplish this, it is common practice to drill bore holes into the desired rock or ore bed. The bore hole is then charged with an initiation assembly which is lowered into the bottom of the bore hole. The initiation assembly contains a very small amount of explosive. The initiation assembly typically includes a blasting cap or detonating cord. The bore hole is then filled with a relatively insensitive main explosive charge e.g. blasting agent or high explosive. The quantity of main explosive charge is very large when compared to the initiation assembly and is designed to perform the desired explosive work, i.e. break the rock. To allow the main explosive charge to perform the desired work, energy is delivered to the initiating assembly causing it to combust or detonate and the output of the initiating assembly causes the main charge to detonate or combust.

In an effort to increase the safety associated with handling the large quantity of main explosives, the mining industry has developed main explosive charges that are inherently insensitive. This feature requires that the initiating assembly provide more energy to initiate the main charge. The incorporation of an explosive booster to the initiation assembly has been the common method to increase the energy available from the initiation assembly. The amplified output from the larger explosive booster charge in turn initiates the large volume of insensitive main explosive charge. Many explosive applications involve the use of cast boosters. The commercial cast booster, a.k.a. cast primer, explosive primer or booster, primer or booster, will be referred to as a booster for the remainder of this disclosure. In summary, the booster is an explosive charge that functions as a transfer charge between an initiator such as a blasting cap or detonating cord and an insensitive main explosive charge. The booster is designed to 1) be sensitive enough so that it can be initiated by an initiator such as a blasting cap or detonating cord, 2) detonate as a result of the initiation stimulus and 3) upon detonation, generate enough energy and power to initiate the relatively insensitive main charge.

The common booster is well known and typically comprises a shaped, sensitive explosive composition or assembly located within a casing, typically a paper, cardboard or plastic container. The shape is typically a mostly solid right cylinder with one or more apertures that are parallel to the axis of the cylinder. The length and diameter of the booster varies and is dependent on the specific end use. Commonly, the booster will be about 1-2 inches in diameter and about 3 to 5 inches in length.

Boosters typically have booster apertures that are designed to accept an initiating device. The two most common initiating devices are a blasting cap and detonating cord. The apertures may be located centrally or off center from the cylinder axis and vary in diameter but typically are between about 0.250 to 0.300 inches in diameter. The depth of the apertures also varies depending upon the design requirements. Commonly, one aperture runs end to end through the booster to accommodate the insertion of a detonating cord. The other aperture is a typically a blind cavity with a depth and diameter designed for the insertion and seating of a blasting cap. The aperture for the blasting cap is commonly called the cap well and is a blind hole with a diameter slightly larger than the blasting cap diameter. The aperture for the detonating cord is typically referred to as the detonator cord thru-hole and is designed to have a diameter that allows a detonating cord to pass through unrestricted. Additional apertures designed for other special initiating devices may also be present. In general, the apertures are referred to as the initiating apertures.

Because the two common types of initiating devices have differing dimensions, configuration and output strength, the booster is commonly designed with features that allow proper coupling of either initiating device to the booster. FIG. 1A depicts a basic booster 7 and FIG. 1B depicts a cross section of the basic booster. FIG. 1C depicts an isometric view of the basic booster. In the case of the blasting cap, a well (a.k.a. cap well) or blind cavity 1 is formed in the booster. For the detonating cord, a thru hole 2 is formed in booster. The basic booster construction is comprised of an enclosure formed by the bottom cap 5, the sleeve 3 and the top cap 4. The top cap 4 is optional. The materials of construction for these items are often cardboard or plastic. The enclosure is filled with the booster explosive 6.

FIG. 2A shows common initiation sources, i.e., a blasting cap 8 or detonating cord 10 that are used with the common booster 7 and FIG. 2B shows the assembly of the booster and initiating devices. When the blasting cap 8 is used as the source of initiation, the blasting cap 8 is inserted into the blind cavity 1. The output of the blasting cap is primarily from the blasting cap end due to the base charge explosive charge 9 inside the blasting cap. When the detonating cord 10 is used as the initiation source, the detonating cord is passed through the booster through the detonator cord channel 2.

FIG. 3 shows a common booster manufacturing method that is based on a melt-pour type casting operation. The main sheath explosive compositions 6 typically have melting points near 1750F. When heated beyond the melting point, the explosive composition becomes fluid. To form a booster, the fluid explosive is poured into containers that serve as a mold as well as a container or enclosure. As shown in FIG. 3A, the container, typically comprised of a bottom cap 5 and casing 3, is pre-assembled to form a cup. Typically, inserted through the bottom cap 5 are removable apertures forming pins 11 that serve to form the channels that will accept the initiating devices. As shown in FIG. 3B, the explosive 6 is poured into the container or enclosure. A top cap 4 with mating holes is often placed over the open end. FIG. 3C represents a cooling stage during which the molten explosive cools and hardens. As shown in FIG. 3D, once the explosive cools and solidifies, the pins 11 are removed from the container resulting in a jacketed solid cylindrical charge having the cap well and the detonator cord thru hole 7.

In field use, the booster design must account for the fact that the pre-set output strength of the initiating devices such as blasting caps or detonating cord must initiate the booster and cause it to detonate. To ensure that the initiating devices can detonate the booster, the booster is made of an explosive that is relatively sensitive such that it can be directly initiated by the blasting cap or detonator cord. One common explosive material that has the required sensitivity is a mixture of the sensitive granular explosive PETN and less sensitive and melt-able explosive TNT. The granular PETN is dispersed in the melted TNT to form the cast-able composition. This combination in certain ratios is commonly referred to as pentolite. However, pentolite is expensive and relatively hazardous to handle during both the booster manufacturing operation and in the field during bore hole loading operations. In addition, unless the process is well controlled, the PETN is able to settle in the liquid TNT resulting in a non-homogenous dispersion of the PETN in the TNT and cast boosters with varying degrees of sensitivity.

U.S. Pat. No. 3,037,452 issued to M. Cook on (Date) and entitled "Booster for Relatively Insensitive Explosives", discloses a booster that involves a small core of sensitive explosive surrounded by less sensitive sheath explosive charge. The sensitive inner charge will herein be referred to as the core and the less sensitive surrounding explosive charge will be herein referred to as the sheath. FIGS. 4A, B, C, D & E depict the core/sheath concept. In accordance with the concept, the core 12 is comprised of a relatively sensitive explosive that is more sensitive than the sheath charge 13. The core is strategically located inside the sheath charge in close proximity to the cap well 1 and/or detonator cord thru-hole 2. Thus, in this configuration, the output of the initiating device initiates the core that in turn initiates the insensitive sheath explosive charge of the booster. This concept reduces the material costs of the booster by reducing the amount of sensitive explosive. Additionally, since the sheath is a less sensitive explosive, the hazards associated with handling the booster in the field are also reduced.

U.S. Pat. No. 3,037,453 discloses a core/sheath cast booster wherein the core is formed by a FIG. 8 configuration of detonating cord.

U.S. Pat. No. 3,604,353 discloses a cast booster assembly comprising a sheath made of two layers and a core. In this concept, a layer of TNT is topped by a layer of pentolite and the detonator cord sensitive core is primarily in contact with the pentolite layer.

U.S. Pat. No. 3,747,527 discloses a core/sheath cast booster that utilizes a cast pre-formed core with cylindrical and similar shapes that have contact with the sides of the initiating channels, i.e., the detonator cord thru hole or cap well.

U.S. Pat. No. 4,776,276 discloses a core/sheath cast booster which utilizes PETN in a sleeve surrounding the detonator cord initiation channel.

U.S. Pat. No. 4,945,808 discloses a core/sheath booster configuration that utilizes a core comprised a rigid waterproof container that contains a loose charge of a sensitive explosive such as PETN.

The core for most prior art adaptations of the core/sheath concept commonly takes the form of an uncompacted, loose charge of granular PETN that is housed in a cylindrical capsule or rubber bladder i.e. balloon. The core is then attached to the mold pins that form the initiating apertures using a tie or elastic band. The main sheath explosive charge is poured into the cardboard cast housing enveloping the core except where the charge is in direct contact with the pins. By design, the core and inner surface of the cap well and detonator cord thru-hole share a common surface, i.e., the core is positioned near the inner surface of the initiation apertures. This prior art method has several drawbacks including 1) the high production costs related to filling the balloons with the PETN and positioning and retaining the balloon about initiation channels, 2) the reduced initiation reliability related to the ability to properly position and retain the balloon in contact with the initiation channel, 3) the hazards associated with the handling of the dry PETN during the balloon filling process, 4) the hazards of handling the booster in the field due to the impact sensitivity of the dry, loosely compacted PETN, 5) the reliability of initiation signal transfer between the detonator and the core due to the variable core coupling with the either initiation apertures, 6) the lack of coupling between the core and the axial output from the blasting cap and 7) the low core output strength available to initiate the sheath explosive due to the use of core formation using a loose, low density explosive.

Another prior art method that is employed utilizes a cast core that has the shape of a cylinder that mates with the aperture forming pins. In this case, the casting is typically made using pentolite. In some cases, the casting is made on the aperture forming pins and once hardened, the sheath explosive is cast around the inner core casting. In other cases, the core is formed and then inserted onto the aperture forming pins and positioned and affixed along the aperture forming pin length. The drawbacks associated with this prior art method are 1) the formation of the core requires an additional casting process, 2) the core composition, pentolite, is relatively hazardous in handling and 3) the lack of coupling between the core and the axial output from the blasting cap.

It is well known in the industry that increasing the distance between a donor explosive, e.g. blasting cap or detonating cord, and an acceptor explosive, e.g. explosive core, will reduce the reliability of initiation or detonation transfer of the acceptor explosive by the donor. Since the output of either the blasting cap or detonating cord must transfer to the inner surface of their respective apertures to initiate the core, the surface area that is mutually shared by the core and the initiation aperture and the proximity of the core to the initiation aperture surface is directly related to the reliable initiation transfer between the initiator and the core. As the mutual surface area between the core and the initiation aperture increases, the transfer of the detonation from the initiator to the core becomes more reliable. Similarly, the closer the core is to the aperture inner surface, the greater the initiation transfer reliability.

The degree of coupling exhibited in the prior art is variable. FIGS. 7 A-I show prior art examples of coupling between the core and the apertures. In FIGS. 7 B & C, the PETN filled balloon core 16 coupling is erratic and, in FIGS. 7 D & E, the cylindrical core 17 has only tangential contact with the aperture inner surface. In FIGS. 7 F & G, the contoured type container or core 18 increases the radial contact with the apertures while, in FIGS. 7 H & I, the donut style core 19 maximizes the radial contact. In all cases, however, there is no axial coupling between the initiator in the blasting cap aperture and the core. Since the most powerful output from the blasting cap is directed axially from the bottom of the blasting cap, this lack of coupling reduces the reliability of detonation transfer between the blasting cap and the core.

The alignment of the core with the initiating apertures is equally critical to the proper function of a core-sheath style booster. The prior art core designs including a donut shape, a dog bone shape, a balloon, a straight capsule or a contoured capsule must be affixed to the molding pins prior to pouring of the sheath explosive. In particular, as related to the blasting cap aperture, the core must be positioned axially to match up with the output from the blasting cap base section. If the core is out of position, the output from the blasting cap will not initiate the core and, thus, the sheath also will fail to initiate.

FIGS. 8 A-E depicts assembly of a core-sheath booster 21 that utilizes a PETN filled balloon style core. In FIG. 8A, the core 16 is manually attached to the pins. This attachment is typically accomplished using an elastic band 20. Next, in FIG. 8B, the bottom cap 5-casing 3 is placed over the pins 11. As shown in FIG. 8C, the molten sheath explosive 13 is then poured into the enclosure. The end cap is attached to the casing and allowed to cool as shown in FIG. 8D. The core-sheath style booster 21 with the formed initiating apertures is removed from the pins 11 once cooled. In this example, a single balloon core must satisfy the coupling for both the blasting cap aperture and the detonator cord aperture. Thus, the core position must be precisely located between the two pins.

FIG. 8F depicts the range and direction that the core could be misaligned. The location of the core can be anywhere along the length of the pin per the Z range and any position around the pin per the path constrained by the X & Y range. In this case, as well as other prior art, the misalignment of the core is related to 1) operator error and 2) movement of the core in the X, Y and Z due to the force from the flowing molten explosive going into the casing and 3) core slippage in the Z direction due to the heating of the attached core. Movement of the explosive core in any of the X, Y or Z directions can increase the distance between the core and initiation source enough to cause detonation transfer failure. Even a small increase in distance can significantly reduce the reliability of detonation transfer from the initiator in the initiating aperture and the core.

One universal characteristic of the explosive core is that it must be sensitive enough to be initiated by a detonator cord or a blasting cap. As a result of the poor coupling design between the core and the initiation apertures or variable distance between the initiation apertures and the core, the core explosive must be relatively sensitive. The typical explosive materials used to make the core include PETN, RDX, tetryl and pentolite. Those skilled in the art of blasting recognize that the ability of the blasting cap or detonating cord to initiate the core explosive charge is related to the intrinsic sensitivity of the basic explosive compound as well as the density of the core explosive composition. Also, it is well known to those skilled in the art that a low density form of the granular explosive is typically more sensitive than a higher density form e.g. compressed or cast, to initiation by the output of a blasting cap or detonating cord. Also, it is well known that the output of the explosive is proportional to the square of the explosive density. In order to account for the poor core coupling and variable core position, yet still provide proper detonation transfer between the initiation source and the core, current practice relies on using a very sensitive core comprised of a loose, low density PETN charge. As a result and due to the lesser output from the low density form, the size of the core must be substantial to properly initiate the insensitive sheath explosive.

The hazards associated with manufacturing and handling explosives are well known. The severity of the hazard is dependent on the type and form of explosive. In practice, the common core-sheath booster designs utilize cores that are comprised of dry, un-compacted, granular PETN. In this form, the PETN is relatively sensitive to inadvertent initiation due to an impact or friction. Thus, handling of PETN during manufacturing is relatively hazardous. Also, the final booster assembly containing the loose PETN core is more susceptible to inadvertent initiation from sources of impact such as are found in a blasting environment.

Prior art cast shaped cores, such as a pentolite explosive admixture which is a melt pour mixture of PETN and TNT, are also relatively hazardous to process and handle due to the inherent sensitivity of PETN. A formed core made with a cast-able composition such as pentolite also requires a separate casting operation. Thus, in order to form the booster, two laborious casting operations are required, one for the core and one for the booster.

The formation of loosely compacted PETN cores requires a loading process that dispenses the PETN in discrete amounts into a charge holder such as a balloon or capsule. This type of loading process is typically a slow laborious operation. The booster assembly operation is based on a melt pour casting type operation. In order to locate the loosely compacted PETN core within the booster, the PETN container must be manually attached to the aperture molding pins. This is commonly accomplished manually using an elastic band. This operation requires significant manual labor. The use of the aforementioned shaped cores also requires process design considerations and related assembly operations to ensure that core is properly positioned. This typically involves increased labor to carry out and ensure the proper positioning. In addition, booster materials costs are driven by the size of the core and the composition of the sheath. Due to the low output of the loose granular explosive core and limited and unpredictable coupling between the initiating apertures and the core, the core explosive quantity must be sized in excess to account for the worst case conditions.

Due to the low output of a loose granular explosive core, the sheath explosive composition must be formulated to have an appropriate sensitivity. The common method to increase the sensitivity of the sheath is to add in specific ratios loose granular explosives such as PETN, RDX or HMX to the melt pour base explosive (typically TNT). Thus, for a low output strength core, such as loose PETN, the sheath must contain a greater amount of the sensitizing granular explosives. Since the granular explosives cost is significantly greater than the TNT base explosive, the cost of the sheath material will increase as a result of a lower strength core.

Therefore, in view of the above discussed limitations of prior art boosters, what is needed is a safe and reliable booster for initiating a main explosive charge that is inexpensive to manufacture and use.

BRIEF SUMMARY OF THE INVENTION

Embodiments of the present invention are directed toward a booster for the initiation of relatively insensitive explosives and a process for manufacturing the booster. It is the intent of this invention to improve the booster's functional reliability, decrease the hazards associated with the booster's assembly and subsequent handling and lower manufacturing costs through the use of a novel booster design.

The novel booster design is based on a core/sheath concept and utilizes a precise pre-formed, mostly cup shaped explosive charge that serves as the booster core. The unique core design significantly increases the reliability of the booster through predictable detonation transfer from a blasting cap or detonating cord to the core and predictable output from the core to initiate the booster sheath charge. The cup shape for the blasting cap provides initiating surfaces for both radial and axial end output from the blasting cap. The shape of the novel core ensures a predictable core location within the booster. The cup feature also reduces the labor associated with core placement during booster assembly. The core is comprised of a granular coated explosive composition that provides predictable flow and low hazard handling properties. These properties allow for the use of a relatively high speed pressing operation to form the core. The result is a core with a highly predictable denkty and size. In addition, the process requires minimal labor to form the core. Also, the pressing operation allows for the precise formation of the core shape. With tight control of the explosive used to make the core and a predictable core formation process that controls the density of the core, the size of the core and the shape of the core, the core design can be optimized for both initiation sensitivity to the blasting cap or detonating cord and the output required to initiate the sheath explosive. Similarly, the sheath explosive can be more closely tailored to the output of the pre-formed core. Precise control of both the core design and the sheath material results in reduced material costs.

An embodiment of the present invention is directed toward an explosive booster for initiating a relatively insensitive main explosive charge. The explosive booster includes a main booster housing. An explosive core containing an explosive composition that is sensitive to initiation by a blasting cap or detonating cord is positioned in the main housing. The explosive core is constructed from a compressed granular explosive composition that is free-flowing prior to being compressed. The granular explosive composition includes an organic binder that makes the granular explosive composition free-flowing and reduces the granular explosive's sensitivity to friction. The compression is controlled to produce an explosive core having a predetermined density and size. The explosive core shape contains at least one initiation aperture that is cup shaped. A sheath explosive that is comprised of a melt cast-able explosive composition surrounds the explosive core. The explosive core is held in place by a mold pin used to form an initiation aperture in the sheath explosive while the melt cast-able explosive composition is poured around the explosive core. The cup-shaped initiation aperture is designed to couple with a blasting cap. At least one initiation aperture axially aligned with the main booster housing forms a channel extending through or partially through the sheath explosive and the explosive core.

Another embodiment is directed toward a method of producing an explosive booster. In accordance with the method, an explosive core having a cup-shaped aperture for receiving a blasting cap for initiating an explosion of an explosive sheath positioned around the explosive core is produced. The explosive core is produced from a free-flowing granular explosive. The granular material is compressed to a produce a core have a predetermined density. The explosive core includes a binder that reduces the granular explosive's sensitivity to friction. The explosive core is held in place by a mating pin while the explosive sheath is poured around the explosive core during a manufacturing process.

Yet another embodiment of the present invention is directed toward an explosive booster that includes an explosive core having a substantially cup-shaped aperture for receiving a blasting cap for initiating an explosion of the explosive booster. The explosive core is formed from a compressed granular explosive such as PETN, TNT, RDX or HMX. The granular explosive includes an organic binder for making the granular explosive substantially free-flowing and reducing the sensitivity of the granular explosive to friction. The booster also includes a through-hole aperture adapted to receive a detonator cord.

BRIEF DESCRIPTION OF THE SEVERAL VIEWS OF THE DRAWINGS

FIGS. 2(A & B) are illustrations of the coupling of a booster with two common initiation sources, a blasting cap and detonating cord;

FIGS. 4(A-E) are illustrations of a core and sheath;

FIGS. 5(A-C) are illustrations of a core/sheath booster showing the ideal coupling zone for the core;

FIGS. 6(A-D) illustrate the explosive output, displayed as vectors, from the detonation of a length of detonator cord and a typical blasting cap;

FIGS. 9(A-E) illustrate a booster with a cylindrical core with an integral cup shape in accordance with an embodiment of the present invention;

FIGS. 10(A-E) illustrate a booster that has a core with the cup shape feature and a thru-hole feature of an embodiment of the present invention;

FIGS. 11(A-C) illustrate a cup shape core and an inherent locating feature in accordance with an embodiment of the present invention;

FIGS. 12(A-C) illustrate a core having a cup, thru-hole feature and inherent locating feature of an embodiment of the present invention;

FIGS. 13(A-F) illustrate various core shapes for particular applications or designs in accordance with an embodiment of the present invention;

FIGS. 14(A-D) illustrate comparative core sizes for two different sheath explosive sensitivities in accordance with an embodiment of the present invention.

DETAILED DESCRIPTION OF THE INVENTION

Figures 1, 1A, 1B, 1C:
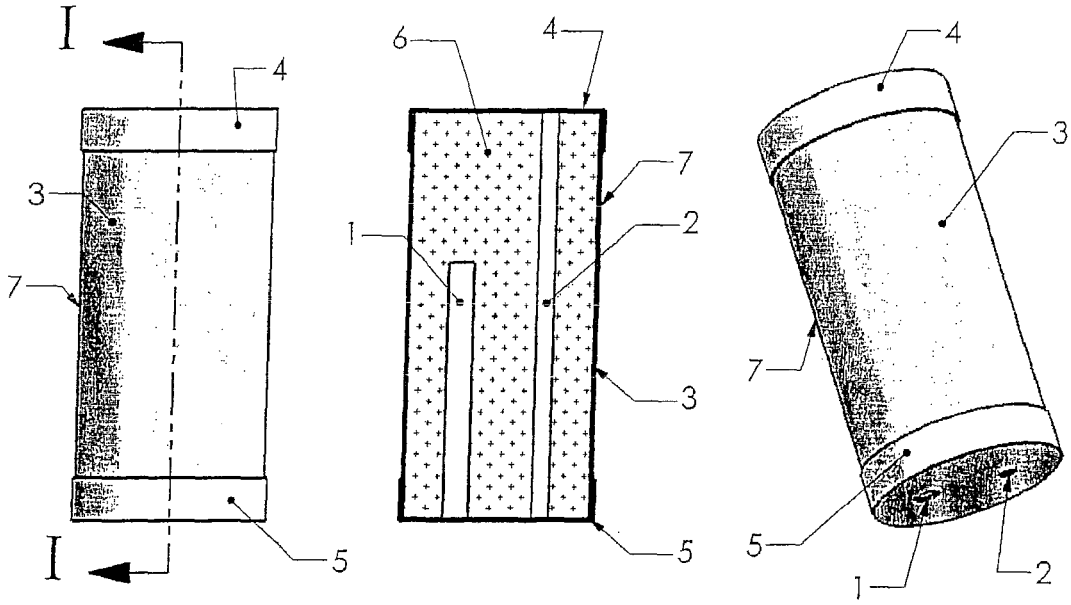
FIGURE 1 (PRIOR ART)
FIGS. 1(A-C) are illustrations of a basic booster.
Figure 3:
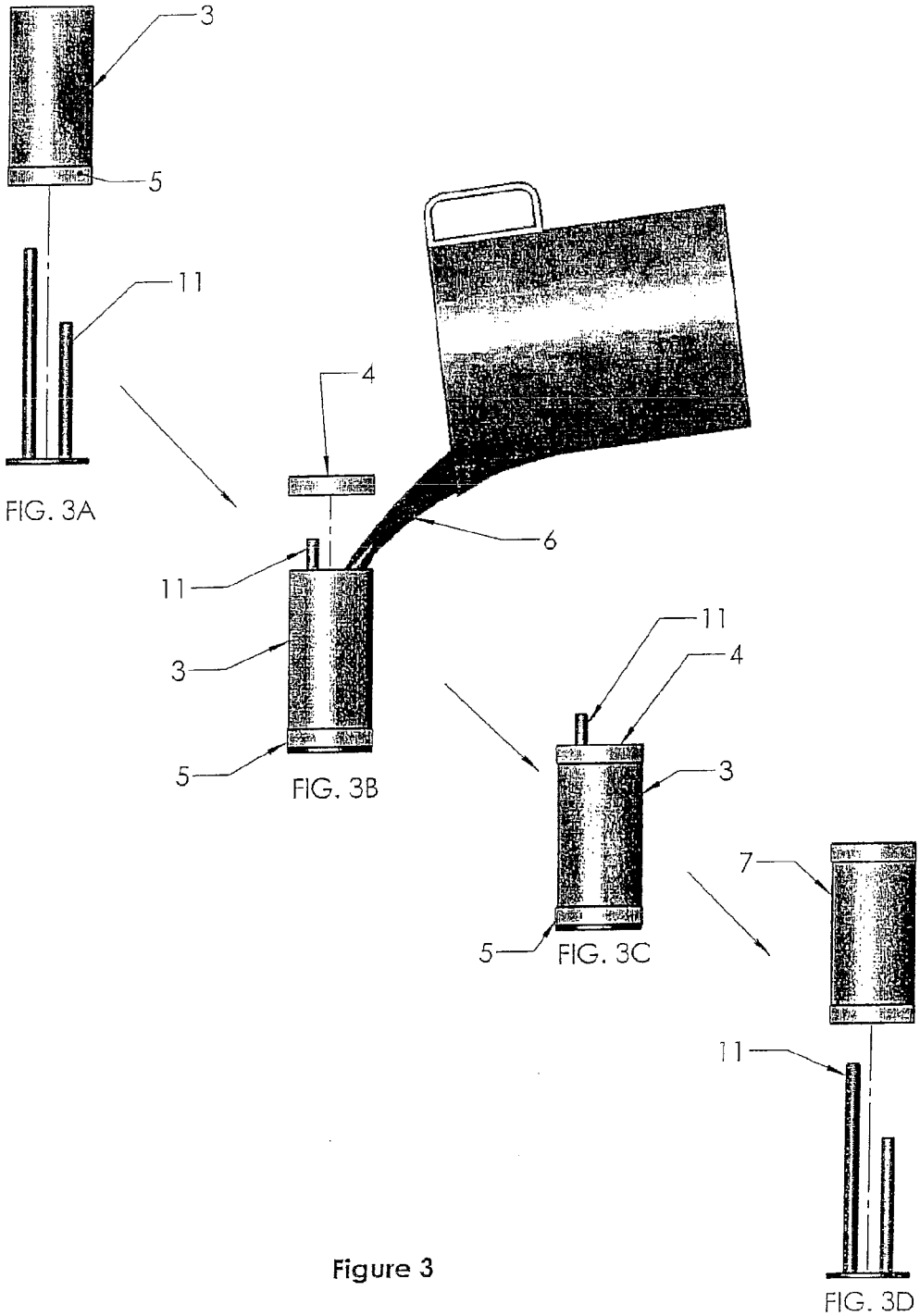
Figure 3 (PRIOR ART)
FIGS. 3(A-D) are illustrations of the booster loading process for a common booster.
Figure 7:
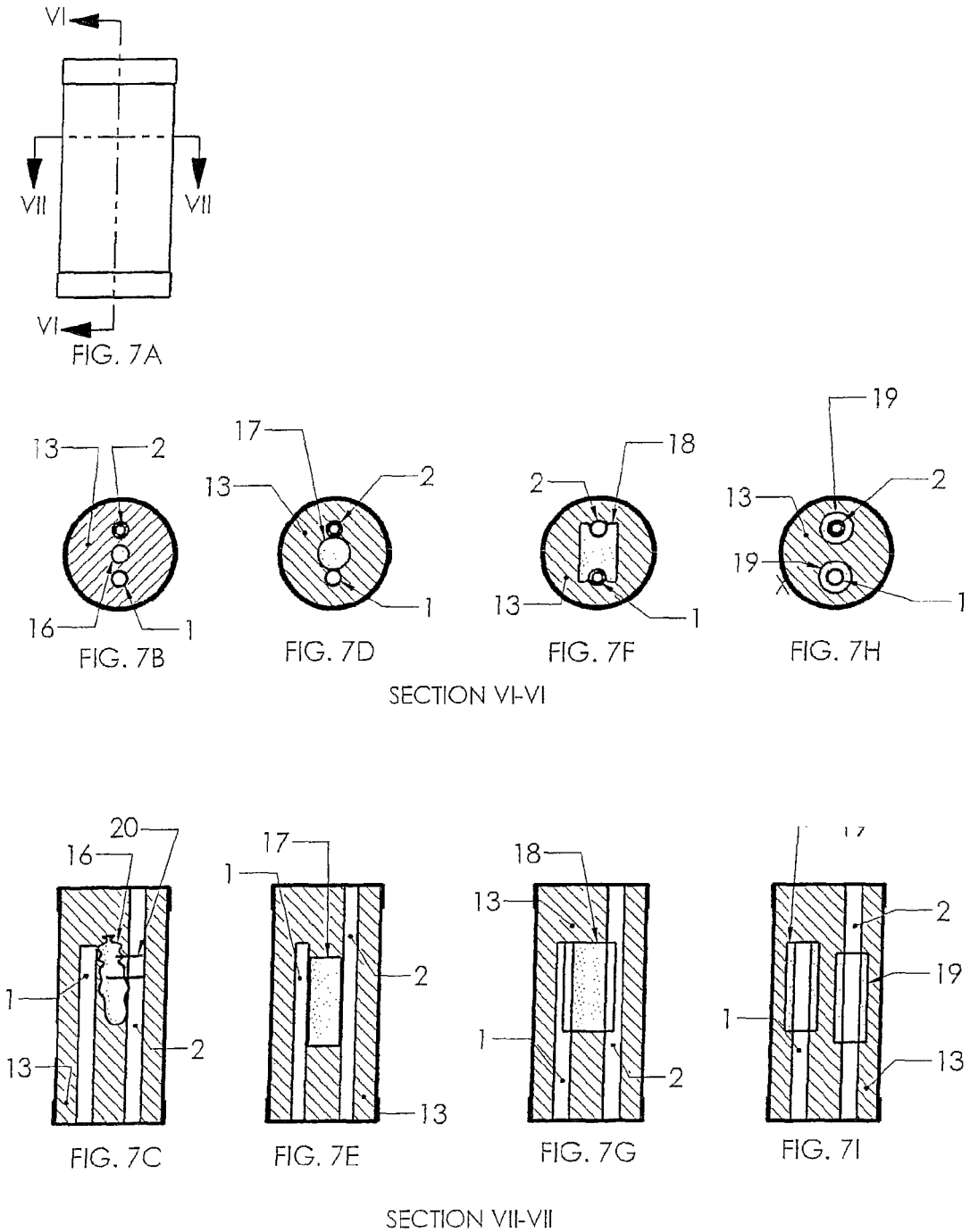
FIGURE 7 (PRIOR ART)
FIGS. 7(A-I) illustrate prior art examples of coupling between the core and the apertures.
Figure 8:
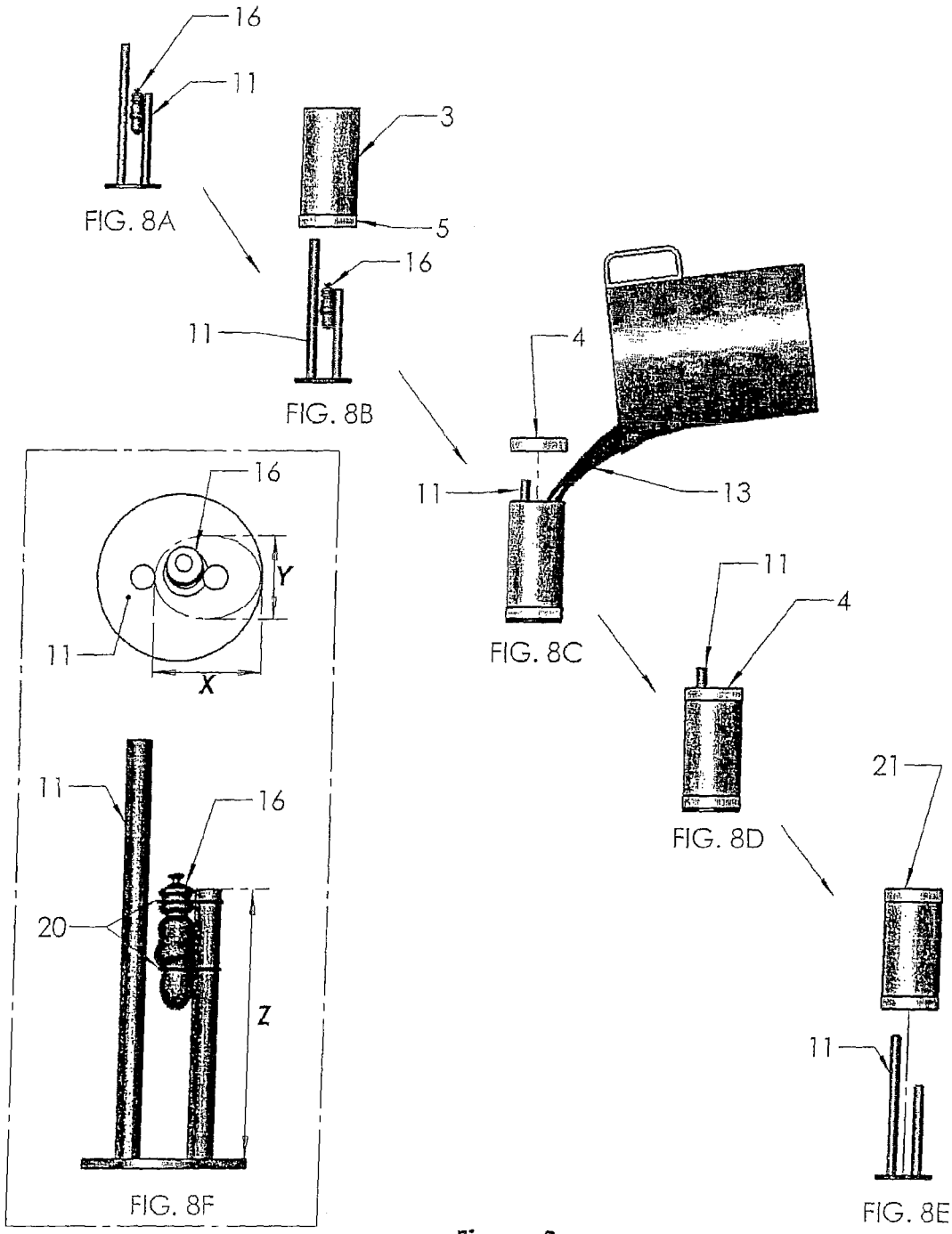
Figure 8 (PRIOR ART)
FIGS. 8(A-F) illustrate assembly of a balloon style core-sheath booster.

Embodiments of the present invention are directed toward a booster for the initiation of relatively insensitive explosives and a process for manufacturing the same. The basic booster design utilizes a blasting cap sensitive or detonating cord sensitive core surrounded by a less sensitive sheath explosive. In accordance with an embodiment of the present invention, a cup shaped aperture is formed in the core to mate with a blasting cap. The process used to make the core and booster allows for simple adjustments to account for various construction materials and end use applications. In addition, the process used to form the core and final booster assembly reduces the required manufacturing labor due to inherent design features of the core and booster that make them suitable for automated manufacturing techniques.

The coupling between the initiation apertures and the core is critical to the proper function of a core-sheath style booster. FIGS. 5 A, B & C depicts a core/sheath booster denoting the ideal coupling zone for the core enveloped by the sheath explosive 13 with respect to the blasting cap aperture and the detonating cord aperture. FIG. 6 depicts the typical explosive output, displayed as vectors, from the detonation of a typical blasting cap, FIGS. 6A & B, and a length of detonator cord, FIGS. 6 C & D. Since the output of the blasting cap emanates from the bottom end due to the base charge 9, the core location 14 in FIGS. 5A & B is located near the bottom end of the blasting cap aperture 1. In addition, it is noted that the output from the blasting cap has both a radial component, FIG. 6B, and an axial component, FIG. 6A. On the other hand, the detonating cord effective output is only radial and is consistent along the length of the detonating cord and, therefore, the ideal core 15, depicted in FIGS. 5C & D, is equally distributed along the length of the detonating cord aperture 2.

The design specifications of the core, and in particular the cup dimensions, of an embodiment of the present invention are sized primarily in accordance with 1) the physical size and design of the blasting cap to be inserted in the cup shaped aperture, 2) the physical size of the detonating cord to be inserted in the thru channel aperture, 3) the detonation output available from the detonating cord and blasting cap for the particular application and, therefore, the required sensitivity of the core to the blasting cap or detonating cord output and 4) the required core output necessary to initiate the sheath explosive.

Embodiments of the present invention improve the initiating efficacy or detonation transfer between the initiation sources, e.g. the blasting cap or detonating cord, and the core. In particular, the booster utilizes a novel core design in the form of a cup that improves blasting cap to core detonation transfer. The embodiments primarily use three core features to improve detonation transfer; pre-formed core shape, core material composition and core density.

The core's explosive composition may include a wide range of explosive materials such as melt pour-able compositions, cast-able compositions as well as granular explosives. Thus, the core may be made using a variety of forming techniques such as cast-curing, melt pouring or powder consolidation. Preferably, the core explosive composition has the form of a granular powder. The preference of a granular form for the explosive used to make the shaped core is based on the ability to use a high speed core manufacturing process, the flexibility to easily change the shape for various applications using the same process, the ability to easily modify the core sensitivity through either formulation or core density modifications. The explosive composition used for the preferred core form is selected from a range of granular explosives that have an initiation sensitivity that can be initiated by the output of the selected initiating device, e.g. a blasting cap or detonating cord. The core explosive composition may contain explosive materials such as, but not limited to, PETN, RDX, HMX, Tetryl et. al. The output of the initiating device may vary depending on the application and initiating device vendor. However, the output of a No. 8 strength blasting cap or a detonating cord with 18 grains per foot of PETN charge represents the typical minimum output that can initiate a common core.

The granular explosive composition used to make the preferred core form must be capable of retaining a structure and shape when consolidated. This capability is enhanced by the presence of a homogenously dispersed binder in the explosive composition. Materials such as waxes and various polymers are used as the binders and are common to those skilled in the art of explosive formulation. In addition to providing the structural strength in the consolidated form, the binder may also impart other significant properties such as resistance to water ingress into the core, proper powder flow characteristics and safe handling properties.

In accordance with an embodiment of the invention, a proper explosive composition used for the core will be a free-flowing granular powder with low friction sensitivity properties such that the powder can be formed into the core shape using a high speed tableting machine. The manufacturing principle of a high speed tableting press is based on filling a precise volume formed by a tooling cavity with the explosive powder. Those skilled in the use of tableting presses recognize that in order to achieve a pre-formed core with a consistent weight and density, the granular powder must be free-flowing with consistent granulation. Once the cavity is filled, a consolidation ram consolidates the powder in the cavity to form the consolidated core. The cavity and mating consolidation ram precisely define the shape of the consolidated pre-formed core. Thus, the use of the proper explosive powder composition, a tableting type consolidation press and shape defining tooling for the press allow for the formation of core having a well defined shape with a precise, controllable density. Since the density of the core is well controlled, the booster designer has the ability to precisely control the sensitivity of the core as well as the output of the core.

The shape of the pre-formed core provides a predictable physical coupling between the initiation source and the core. This physical coupling increases the reliability of detonation transfer between the initiation source and the core. The pre-formed core design improves both the blasting cap-to-core coupling as well as the detonating cord-to-core coupling. To improve the blasting cap-to-core coupling, the invention utilizes a pre-formed core that is designed to closely couple with both the radial and axial output of a blasting cap. This is accomplished by forming a cup shape in the pre-formed core. FIGS. 9 A-D illustrate a booster with a cylindrical core 22 and FIG. 9E illustrates the cup form in the core 23.

To improve the detonating cord-to-core coupling, in addition to the greater radial coupling surface area, the pre-formed core provides a more uniform density to allow better initiation predictability. FIGS. 10 A-D depict a booster that uses a pre-formed core 24, shown in FIG. 10E with the cup shaped feature 25 for the blasting cap aperture and also a thru-hole feature 26 for the detonator cord aperture.

Another unique feature of the pre-formed core design in accordance with an embodiment of the present invention is the ability to precisely locate the core within the sheath. FIGS. 11 and 12 depict the core locating features. The precise vertical location is a result of mating the pre-formed core cup feature with the short pin of the aperture forming pins 11 that form the blasting cap aperture during the casting process. FIGS. 11A-C depict the simple cup shaped core 22 and its inherent locating feature. Once positioned on the aperture pin, the core is fixed in the vertical position (Z axis), as shown in FIG. 11B, simply due to the weight of the core and gravity. In this case, where the core is a simple cup shape as shown in FIG. 11A, the X-Y direction is fixed simply by the mating core cup and the molding pin position. If the pre-formed core also has a design feature to couple with the detonating cord aperture, the long pin of the aperture forming pins 11 used to form the detonating cord aperture mates with a shape feature of the core to precisely locate the core along each of the X, Y and Z axes. FIGS. 12 A-C depict a core 24 having a shape with both a cup and through hole feature that precisely controls the core location within the sheath. Once positioned on the aperture pins, the core is fixed in the vertical position (Z axis) as shown in FIG. 12B simply due to the weight of the core and gravity. In this case, where the core has both a cup shape for the blasting cap and a thru hole for the detonator cord, the X-Y direction is fixed per FIG. 12A by mating the pre-formed core cup aperture and the thru-hole aperture with the respective molding pin 11.

In accordance with an embodiment of the invention, the pre-formed core has a cup feature for the blasting cap aperture. An advantage of this is that simply by making a defined tooling change in the core forming process, the cup feature as well as other features can be formed that provide application specific improved core-initiating aperture coupling. In particular, the concept allows for the formation of a well defined channel that mates with the detonator cord aperture or forms a second blasting cap aperture. FIG. 13 depicts a few examples of modified shapes that may accommodate particular applications or designs. FIGS. 13 A & B display a basic cylindrical core with the integral cup shape except that the cylinder has a major and minor outside diameter 25. The larger diameter is designed to provide a tangential coupling with the detonator cord aperture. FIGS. 13 C & D display the basic cylindrical core with the integral cup shape plus a larger base form, mostly elliptical with a cutout 26 to provide a semi circular coupling between the core and the detonator cord channel 2. FIGS. 13 E & F display a single core design that has two integral cup features 27 for the purpose of redundancy.

In addition to the basic configuration, the overall size of the core can be modified to account for differing detonation transfer properties between the core and the sheath explosive. As an example, FIG. 14 illustrates a comparison between two cores, FIGS. 14A & B represent a standard size pre-formed core 28 used to initiate a common sheath material such as a 60:40 TNT-RDX mixture and FIGS. 14C & D depict a larger pre-formed core 29 designed to initiate a less sensitive sheath explosive such as a 80:20 TNT-RDX mixture.

Because of the pre-determined core shape of embodiments of the present invention, the process for handling the core is predictable. This improved handling factor results in reduced labor and reduces the hazards associated with handling explosives. The presence of a binder in the core composition also tends to reduce the sensitivity of the explosive composition to normal handling hazards. In addition, the preferred core design utilizes a granular explosive composition that allows the core to be made using an automated high speed consolidation process. As a result, the core manufacturing labor content is minimal.

Figure 15:
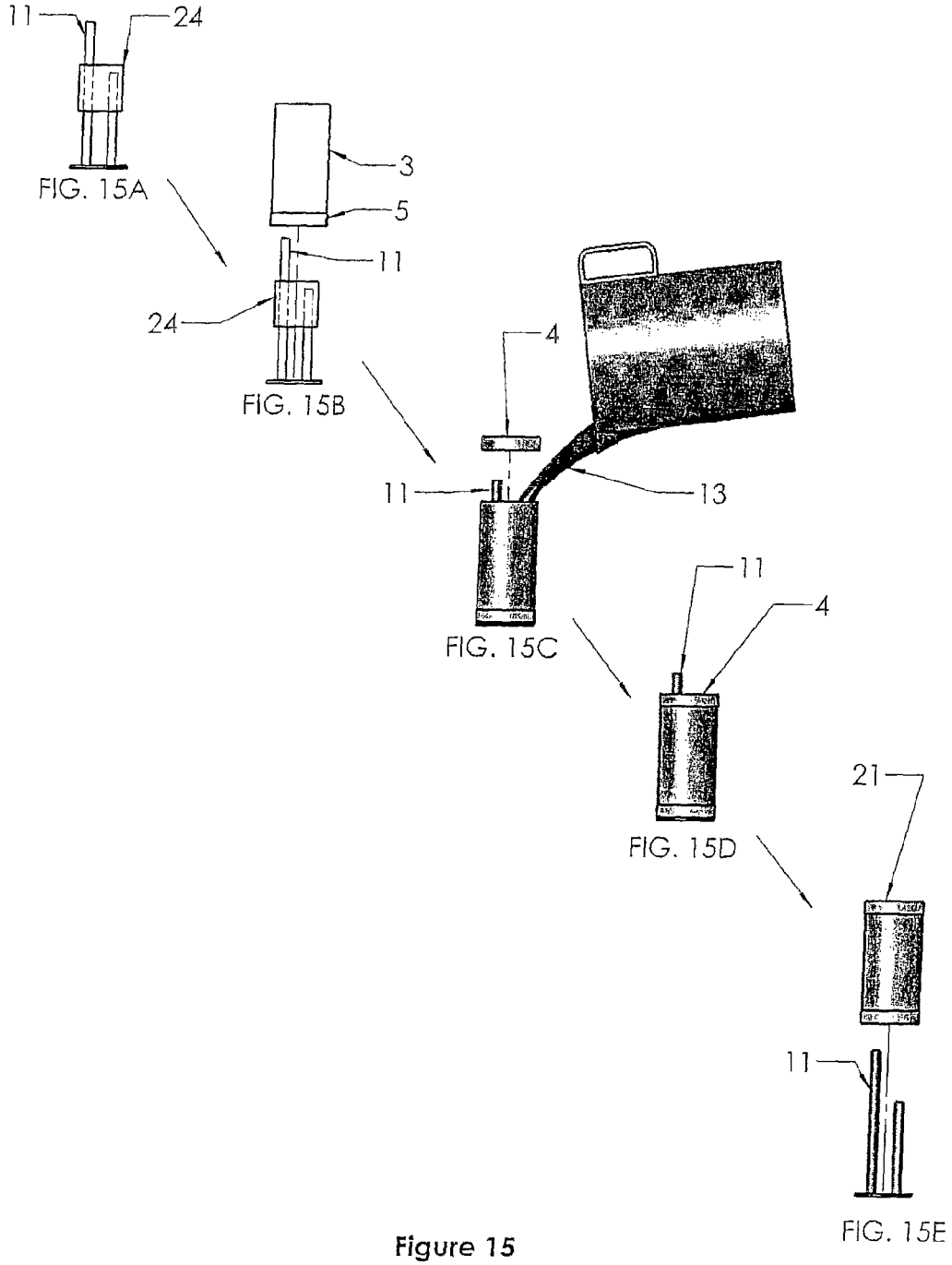
FIGS. 15(A-E) illustrate a booster assembly process using a pre-formed core with a cup feature and detonator cord thru hole in accordance with an embodiment of the present invention.

FIGS. 15 A-E depict the booster manufacturing process for a pre-formed core that has the cup feature for the blasting cap aperture as well as a thru-hole for the detonator cord aperture. The unique cup shaped aperture of the pre-formed core allows the core to be seated onto the blasting cap aperture forming pin in the booster mold. In this case, where the core includes other features designed to couple with a detonating cord, the feature in the core for the detonating cord mates with the detonating cord aperture forming pin in the booster mold as shown in FIG. 15A. If the pre-formed core does not have a feature for the detonating cord aperture, the pre-formed core is only seated onto the pin that forms the blasting cap aperture. In accordance with the invention, the cup shape controls the vertical (Z) position of the core in the booster while the X-Y location, important when the core contains a detonating cord feature, is controlled by that features mating characteristic with the mold pin. Thus, these features locate the core in the booster without the need to manually attach the core to the pins using elastic bands and the like. Also, due to the well defined shape of the core and its inherent locating features, the placement of the core onto the pins can be accomplished manually or via conventional automation pick and place techniques. Thus, the labor associated with placing and positioning the core onto the molding pins is significantly reduced in accordance with an embodiment of the present invention.

Due to the precise shape and density of the pre-formed core and the resultant coupling between the core and the initiation sources in accordance with embodiments of the present invention, the amount of core material can be minimized. Similarly, the output of the core is very predictable thereby allowing the core to be sized to accurately meet the input needs of the sheath explosive. That is, the core output strength can be tailored to meet the initiation requirements of a range of booster sheath explosives. Thus, savings in material costs are achieved by avoiding the use of excess charge sizes due to inefficiencies related to poor initiation source-core coupling and low output strength core densities. Also, since the size and output of the pre-formed core can be easily adapted to meet the initiation needs of the sheath explosive, the sheath explosive material is not limited to common explosive compositions thereby allowing the use of the most economical composition.

In accordance with an embodiment of the present invention, the pre-formed explosive core has the cup shape 22 shown in FIG. 9. The cup's inside diameter is designed to allow a blasting cap to fit down into the cup. While special applications may require a specific inner diameter, the preferred inner diameter is 0.328 to accommodate the typical blasting cap diameters. For the exemplary embodiment shown, the core explosive composition can be comprised of 90-99% granular explosive such as PETN, RDX or HMX and 1-10% organic binder such as paraffin wax. The sheath explosive can be a composition containing 40-50% TNT, 40-50% granular RDX and 0-10% granular PETN. The minimum length of the cup depth is designed to match up with the explosive base charge length of the common blasting cap. The typical minimum length is about 1.375 inches and the preferred cup depth is 1.125 inches. The thickness of the cup bottom is designed to provide sufficient output upon initiation by the end output from the blasting cap. While the thickness may vary based on the application and explosives used for the booster, the preferred minimum thickness is 0.250 inches. The outside diameter is sized to provide sufficient output from the core to initiate the booster sheath explosive. The preferred diameter is 0.62 inches. The resultant preferred weight is 7 to 9 grams.

Although there have been described particular embodiments of the present invention of a new and useful cast booster having a novel explosive core, it is not intended that such references be construed as limitations upon the scope of this invention except as set forth in the following claims.

What is claimed is:

1. An explosive device for initiating a relatively insensitive main explosive charge comprising:

a booster with a main booster housing;

an explosive core containing an explosive composition that is the most explosive composition of the booster, the explosive composition being sensitive to initiation by a blasting cap or detonating cord;

the explosive core having a top surface, side surface and bottom surface and at least one initiation aperture;

the at least one initiation aperture having a cup shape with an interior side wall and an interior bottom wall, the side wall and bottom wall of the at least one initiation aperture are exposed surfaces of the explosive composition of the explosive core; and the explosive core having a cup bottom thickness measured from the bottom wall of the at least one initiation aperture having a cup shape to the bottom surface of the explosive core;

the at least one initiation aperture having a cup shape for physically coupling a blasting cap to the explosive core with the explosive core containing the most sensitive explosive of the booster;

a sheath explosive that covers the explosive core at least partially on the side surface, bottom surface and top surface wherein the sheath explosive is comprised of a melt cast-able explosive composition; and a blasting cap positioned within the cup-shaped initiation aperture in direct contact with the exposed surface of the explosive composition of the explosive core.

2. The explosive booster of claim 1 further comprising at least one initiation aperture axially aligned with the main booster housing that forms a channel extending through or partially through the sheath explosive and the explosive core with a cup bottom thickness of at least 0.250 inches.

3. The explosive booster of claim 1 wherein said cup-shaped initiation aperture has an inner diameter of about 0.328 inches.

4. The explosive booster of claim 1 wherein said sheath explosive comprises a melt cast-able explosive composition.

5. The explosive booster of claim 1 wherein the explosive core is held in a predetermined location by a locating feature while said melt-castable explosive composition is poured around said core to form said explosive sheath.

6. The explosive booster of claim 1 wherein the explosive core comprises a compressed granular explosive composition, the compressed granular explosive composition being a free-flowing granular explosive prior to being compressed.

7. The explosive booster of claim 6 wherein the granular explosive composition includes an organic binder that makes said granular explosive composition free-flowing and reduces said granular explosive's sensitivity to friction.

8. The explosive booster of claim 7 wherein said compression is controlled to produce an explosive core having a predetermined density and size.

9. A method of producing an explosive booster comprising:

a) using at least one tableting press to fill a volume formed by a cavity with free-flowing explosive material, the free-flowing explosive material being a granular explosive material and also a binder;

b) consolidating the free-flowing explosive material in the cavity to form an explosive core having a cup-shaped aperture for physically coupling a blasting cap for initiating an explosion of an explosive sheath positioned around said explosive core wherein the explosive core's cup-shaped aperture has an exposed interior side surface with no covering of the side surface and an exposed interior bottom surface with no covering of the bottom surface for direct contact with the blasting cap.

10. The method of claim 9 further comprising mating the explosive core within the sheath with at least one aperture forming pin.

11. The method of claim 9 wherein the free-flowing explosive material is compressed to a produce an explosive core have a predetermined density.

12. The method of claim 10 wherein said explosive core is held in place by a mating pin while said explosive sheath is poured around said explosive core during a manufacturing process.

13. The method of claim 9 further comprising the step of casting a sheath explosive comprised of a melt-castable explosive around the explosive core while said explosive core is held in position by a locating feature.

14. An explosive device comprising:

a blasting cap and an explosive core having a substantially cup-shaped aperture with internal dimensions for receiving the blasting cap having external dimensions for initiating an explosion of said explosive booster wherein the internal dimensions of the cup shaped aperture are sized to the external dimensions of the blasting cap within the cup-shaped aperture of the explosive core; and the cup-shaped aperture of the explosive core in direct contact with the blasting cap and no barrier between the cup-shaped aperture of the explosive core and the blasting cap.

15. The explosive booster of claim 14 where said explosive core is formed from a compressed granular explosive.

16. The explosive booster of claim 15 wherein said granular explosive includes an organic binder for making said granular explosive substantially free-flowing.

17. The explosive booster of claim 15 wherein said granular explosive includes a binder for reducing a sensitivity of said granular explosive to friction.

18. The explosive booster of claim 14 wherein said booster includes a through-hole aperture adapted to receive a detonator cord.

19. The explosive booster of claim 14 wherein said explosive core comprises PETN, TNT, RDX or HMX.

20. An explosive device for initiating a relatively insensitive main explosive charge comprising:

a booster with main booster housing;

an explosive core containing an explosive composition that is the most explosive composition of the booster, the explosive composition being sensitive to initiation by a blasting cap or detonating cord;

the explosive core having a top surface, side surface and bottom surface and at least one initiation aperture;

the at least one initiation aperture having a cup shape with an interior side wall and an interior bottom wall, the side wall and bottom wall of the at least one initiation aperture are exposed surfaces of the explosive composition of the explosive core; and the explosive core having a cup bottom thickness measured from the bottom wall of the at least one initiation aperture having a cup shape to the bottom surface of the explosive core;

the at least one initiation aperture having a cup shape for physically coupling a blasting cap to the explosive core with the explosive core containing the most sensitive explosive of the booster;

a sheath explosive that covers the explosive core at least partially on the side surface, bottom surface and top surface wherein the sheath explosive is comprised of a melt cast-able explosive composition;

a blasting cap positioned within the initiation aperture in direct contact with the exposed surface of the explosive composition of the explosive core; and no barrier between the blasting cap and the initiation aperture.

* * * * *